United States Patent [19]

Burger

[11] Patent Number: 5,031,530

[45] Date of Patent: Jul. 16, 1991

[54] VERSATILE EIGHT-CYLINDER PRINTING MACHINE, AND PRINTING METHOD

[75] Inventor: Rainer Burger, Augsburg, Fed. Rep. of Germany

[73] Assignee: Man Roland Druckmaschinen AG, Offenbach am Main, Fed. Rep. of Germany

[21] Appl. No.: 528,583

[22] Filed: May 24, 1990

[30] Foreign Application Priority Data

Jun. 3, 1989 [DE] Fed. Rep. of Germany ..... 3918127

[51] Int. Cl.[5] ..... B41M 1/14; B41F 5/16

[52] U.S. Cl. ..... 101/211; 101/180; 101/182; 101/212; 101/220; 101/152; 101/139

[58] Field of Search ..... 101/212, 216, 219, 220, 101/221, 152, 170, 174, 175, 176, 177, 178, 179, 180, 181, 182, 183, 184, 185, 211, 139, 140

[56] References Cited

U.S. PATENT DOCUMENTS

| | | | |
|---|---|---|---|
| 3,329,086 | 7/1967 | Pullen | 101/182 |
| 4,250,809 | 2/1981 | Pullen | 101/221 |
| 4,286,519 | 9/1981 | Smith | 101/176 |
| 4,369,705 | 1/1983 | Gelinas | 101/180 |
| 4,398,404 | 8/1983 | Morbitzer | 101/221 |
| 4,526,099 | 7/1985 | Niemiro et al. | 101/220 |
| 4,788,912 | 12/1988 | Fischer | 101/180 |
| 4,821,640 | 4/1989 | Hajek et al. | 101/177 |
| 4,833,982 | 5/1989 | Liebert et al. | 101/180 |
| 4,934,265 | 6/1990 | Knauer | 101/177 |
| 4,967,515 | 10/1987 | Germann | 101/179 |

*Primary Examiner*—Eugene H. Eickholt

*Attorney, Agent, or Firm*—Frishauf, Holtz, Goodman & Woodward

[57] ABSTRACT

To permit easy change-over between double-prime, double-verso (2/2) printing on a substrate web (5) and double-prime, single-verso (2/1) printing, the cylinders are arranged in printing couples so that first and second blanket cylinders (1, 2) are in printing engagement with each other, with the web (5) therebetween and printing couples including blanket cylinders (3, 4) independently of the blanket cylinders (1, 2) are in engagement with each other, with the web therebetween. One (3) of the blanket cylinders of the printing couples is eccentrically shiftable from engagement with the associated blanket cylinder into engagement with another blanket cylinder (2) so that said other blanket cylinder will function as an impression cylinder for one prime image, and as a printing cylinder for the verso image, while, at the same time, another prime image is being applied thereagainst by the shifted blanket cylinder (3). The systems can be multiplied, preferably staggered vertically, with the substrate in form of a web being guided therebetween. The system permits complete disengagement of the printing couple prior to shifting of the shiftable blanket cylinder, and thus avoids smearing of freshly printed subject matter.

6 Claims, 2 Drawing Sheets

30'
40'
4'
3'
7
1'
2'
20'
10'
5
30
40
4
3
6
2
1
20
10

VERSATILE EIGHT-CYLINDER PRINTING MACHINE, AND PRINTING METHOD

FIELD OF THE INVENTION

The present invention relates to an eight-cylinder printing system, and more particularly to such a system which is versatile in that it can be readily changed over from double-sided or prime-and-verso printing of two images (2/2) to double-image prime and single-image verso (2/1) printing, without smearing of freshly printed subject matter.

BACKGROUND

Eight-cylinder printing machines use four printing couples, in which a first, second, third and fourth rubber blanket cylinder, each, is in engagement with a plate cylinder. To provide for dual-image prime and verso (2/2) printing, a substrate, for example a web of paper is passed between a first and second rubber blanket cylinder, and then, spaced therefrom, a third and fourth rubber blanket cylinder.

For some installations, it is desired to provide only one printing image on a specific side, for example the verso side, whereas two color images are desired on the opposite or prime side. The referenced textbook "Techniken, Systeme, Maschinen" ("Technology, Systems, Machines") by Oskar Frei, published by Polygraphverlag, page 11, FIG. 21, picture 4, describes a printing system having four printing couples. To obtain, as described in the textbook, 2/1 printing or 1/2 printing, that is, only a single image on one side of the web, it is necessary to disengage a plate-blanket pair from printing effectiveness. One of the blanket cylinders, however, will be required to form an impression cylinder for that one of the sides which requires dual image printing. This results in serious disadvantages since the plate cylinder, which is not needed and which frequently is driven, then must be disengaged from the blanket cylinder which is needed as the impression cylinder for the second prime image. Inkers and dampers associated with the plate cylinder likewise have to be disengaged. Of course, the situation can be reversed or the mirror-image printing arrangement may be required, namely one image on the prime side and a double image on the verso side. What has been said above is, of course, equally applicable thereto

THE INVENTION

It is an object to improve an eight-cylinder printing unit to permit, respectively, 2/2 or double-image prime and verso printing, for which it is eminently suited and, also, simple conversion to 2/1 or, respectively, 1/2 printing with only one image on one of the sides of the printing web, and without requiring a blanket cylinder, which carries no printing image, to function as an impression cylinder.

Briefly, for printing in a mode of double-prime and single verso printing (2/1) or, respectively, the reverse (1/2), a first and second blanket cylinder are placed in engagement with each other, with the substrate therebetween; and the third blanket cylinder is then moved to be in engagement with the second blanket cylinder, so that the second blanket cylinder will also form the impression cylinder for the image carried on the third blanket cylinder, with the substrate still therebetween. The third and fourth blanket cylinders are thereby out of mutual engagement, which additionally permits completely disabling the fourth printing couple, including the associated inkers and dampers.

The first and third blanket cylinders, thus, then will apply printing on one side of the web and the second blanket cylinder will supply one printed image on the other side of the web, and function, additionally, as an impression or counter cylinder for the third blanket cylinder.

Separating the fourth blanket cylinder from the third blanket cylinder has the substantial advantage that, in accordance with the invention, smearing of an image printed by the second blanket cylinder is effectively avoided.

DRAWINGS

FIG. 1 is a highly schematic side view of a pair of vertically positioned eight-cylinder printing systems which show, in full line, the operation of the system in a 2/1 or, respectively, 4/2 operating mode; and FIG. 2 is a view similar to that of FIG. 1 in which the printing modes are 2/2 or 4/4, respectively.

The small triangles next to the web 5 in FIGS. 1 and 2 illustrate, schematically, in each case the number of printing images transferred by the respective printing cylinders of the respective printing systems.

DETAILED DESCRIPTION

Figure 1:
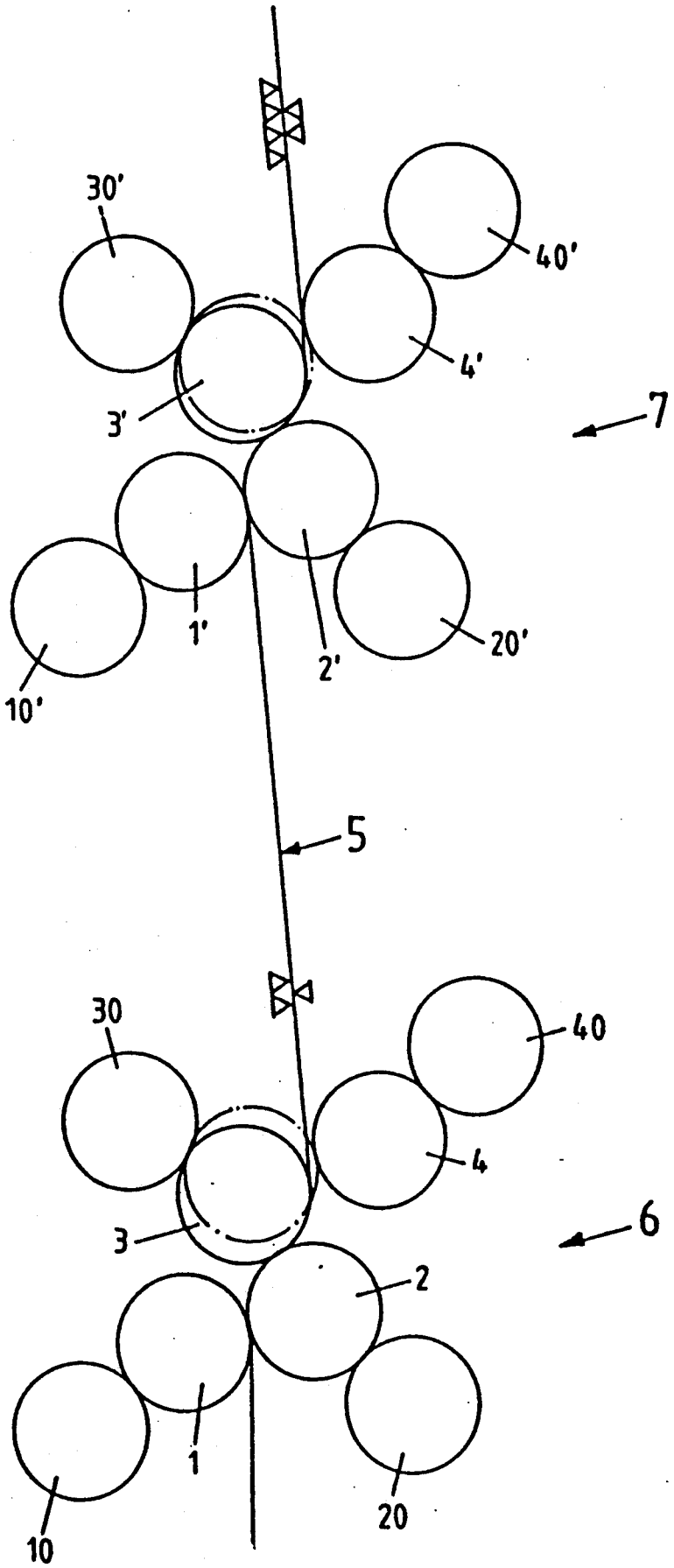

FIG. 1, at the lower portion thereof, shows the blanket cylinders 1, 2, 3, 4 and associated plate cylinders 10, 20, 30, 40. These cylinders are located essentially as shown in the full-line position in FIG. 1. By placing cylinders 1–4 and 10–40, it is possible, contrary to the prior art, to readily separate the third plate cylinder 3 from the fourth blanket cylinder 4 and engage it against the second blanket cylinder 2, as shown in the full-line position in FIG. 1. The broken-line position of blanket cylinder 3, in FIG. 1, shows the arrangement which is illustrated in full-line position in FIG. 2, namely for 2/2 printing. A substrate, for example a web of paper 5, is guided between the printing systems 6, 7, for example in essentially vertical direction to provide, in accordance with FIG. 1, dual-prime and single-verso printing, as illustrated by the triangular symbols on the web 5 downstream, that is, vertically above the respective printing systems.

In accordance with a preferred feature of the invention, a second printing system 7 is located in position to print on the web 5, preferably centrally vertically above the printing system 6. Thus, selectively, and in accordance with the respective cylinder positions of FIG. 1, 4/2 printing can be obtained. The printing system 7 is identical to the system 6, and the same reference numerals have been used, with prime notation.

The system of FIG. 1, in full-line position, is shown with the cylinder unit 6 providing 2/2 printing, the chain-dotted position of the cylinder 3 corresponding to that of FIG. 1.

Figure 2:
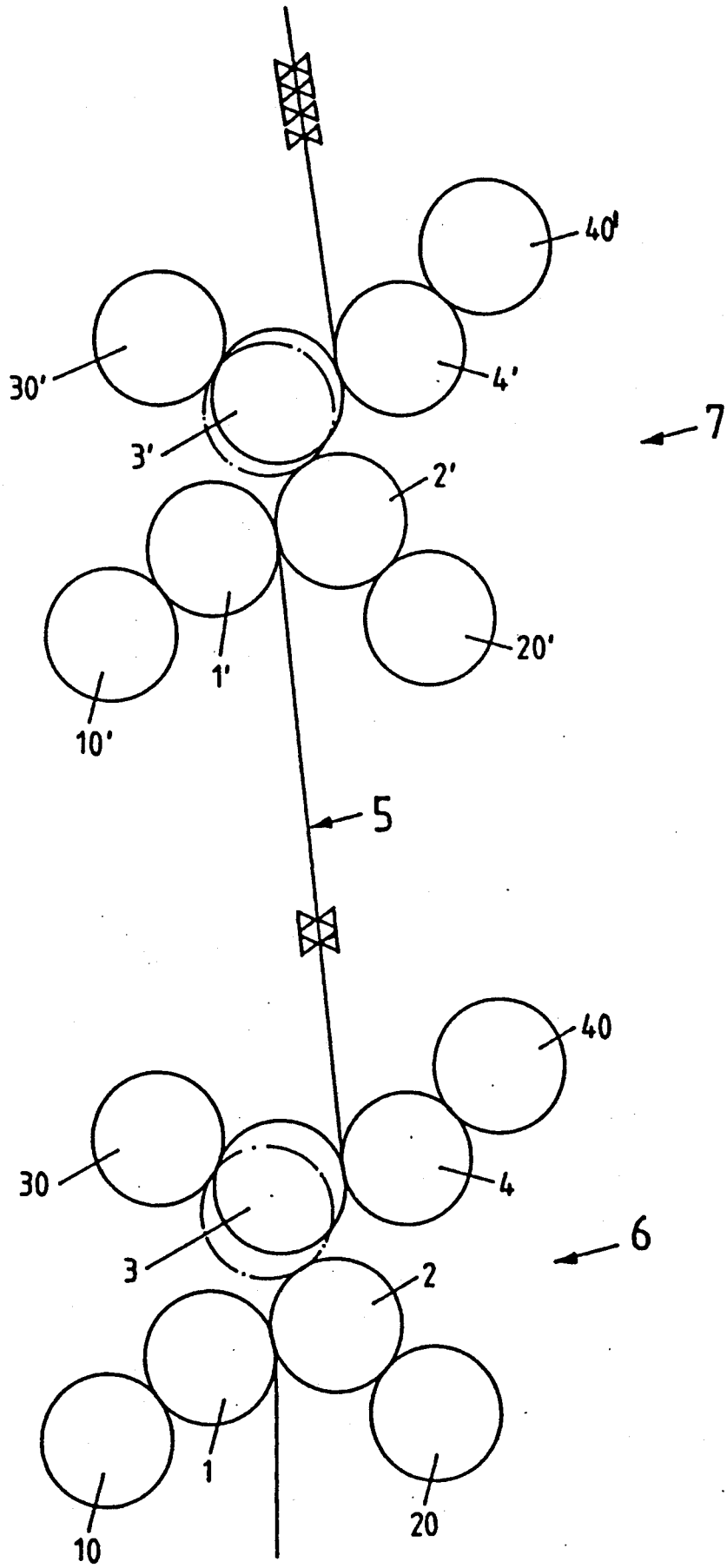

As illustrated in FIG. 2, both or either one of the units 6, 7 provide for 2/2 printing which, downstream of the units of FIG. 2, will result in 4/4 printing images. As clearly seen in FIG. 2, the third blanket cylinder 3 is in engagement with the fourth blanket cylinder 4, with the web 5 therebetween, and thrown off from the blanket cylinder 2. The blanket cylinders 1, 2 are separate and apart from the blanket cylinders 3, 4.

Movement of the cylinder 3 can readily be effected by a well known throw-off mechanism, for example by an eccenter, to shift the center of rotation of the cylinder 3 between the full-line position (FIG. 1) and the chain-dotted position thereof, which corresponds also to the full-line position in FIG. 2. Such eccentric throw-off mechanisms are well known.

Of course, the arrangement could be changed right-for-left, namely the mirror image of the arrangement shown in FIGS. 1, 2. For example, FIG. 1 illustrates the combination printing couples 3, 30 and 4, 40 offset towards the right with respect to the printing couples 1, 10 and 2, 20. This offset, of course, could be reversed and if, in accordance with FIG. 1, the cylinder group 3, 30 and 4, 40 is shifted towards the right, the same conditions will pertain except that then the blanket cylinder 4 will take on the function of the blanket cylinder 3 and will be eccentrically shiftable for engagement with the cylinder 2. The offset location to provide a "wrap-around" effect for the web 5, as such, is standard practice in many printing machines.

Various changes and modifications are possible. For example, and in accordance with a feature of the invention, 2/2 printing or, respectively, 4/4 printing can also be obtained by utilizing the full-line engagement arrangement of FIG. 1 and then positioning the fourth blanket cylinder 4, 4', respectively, for engagement with the so-positioned third blanket cylinder 3, 3'.

What is claimed is:

1. A method of operating an eight-cylinder printing machine to print on a substrate (5), said printing machine having four printing couples, each including
- a first, second, third and fourth blanket cylinder (1, 2, 3, 4), and
- a first, second, third and fourth plate cylinder (10, 20, 30, 40) operatively associated with the respective blanket cylinder, for printing on said substrate,
- said method comprising, for printing in a first mode, of
- (a) double-sided prime-and-verso printing (2/2)
  - (a1) guiding said substrate (5) between the first and second blanket cylinders (1, 2) to, each, apply first prime and verso images, and
  - (a2) between the third and fourth blanket cylinders (3, 4) to apply second prime and verso images; and, selectively, in a second mode, of
- (b) double prime and single verso printing (2/1);
  - (b1) guiding said substrate (5) between the first and second blanket cylinders (1, 2) to apply first prime and verso images.
  - (b2) disengaging the fourth blanket cylinder and said fourth printing couple from engagement with the third blanket cylinder (3); and
  - (b3) engaging the third blanket cylinder (3) with said second blanket cylinder (2) and guiding said substrate (5) between the third and second blanket cylinders to provide for printing a second prime image on said substrate and to operate said second blanket cylinder as an impression cylinder for, respectively, printing by said first and third blanket cylinders.

2. The method of claim 1, for, selectively, printing in a mode
- (c) of double-prime, double-verso printing,
  - (c1) guiding said substrate (5) between the first and second blanket cylinders (1, 2) to, each, apply first prime and verso images, and
  - (c2) engaging the third blanket cylinder (3) with said second blanket cylinder (2) and guiding said substrate (5) between the third and second blanket cylinders to provide for printing a second prime image on said substrate; and
  - (c3) engaging said fourth blanket cylinder (4) of the fourth printing couple with the third blanket cylinder (3) to provide a second verso printed image on said substrate,
- to operate said second blanket cylinder as an impression cylinder, selectively, with respect to said first and third blanket cylinder.

3. The method of claim 1, for providing, selectively, quadruple prime and double verso (4/2), or quadruple prime and quadruple verso (4/4) printing,
- comprising
- carrying out the method of claim 4 in two printing systems, each including said four printing couples, said method further including
- positioning said printing systems one above the other and guiding said substrate (5) essentially vertically one above the other through said printing system.

4. Eight-cylinder printing machine for printing on a substrate (5), having
- four printing couples, each including
- a first, second, third and fourth blanket cylinder (1, 2, 3, 4), and
- a first, second, third and fourth plate cylinder (10, 20, 30, 40) operatively associated with the respective blanket cylinder, for printing on said substrate, said printing couples being positioned, for printing in a first printing mode:
- (a) double-side prime-and-verso printing (2/2) wherein
  - (a1) the first and second blanket cylinders (1, 2) are in engagement, with the substrate (5) therebetween, to print first and second prime and verso images, and
  - (a2) the third and fourth blanket cylinders are in engagement, with the substrate (5) therebetween, to print second prime and verso images, said first and second blankets cylinders and said third and fourth blanket cylinders being separate from each other,
- and, for printing in a second mode,
- (b) double-prime and single-verso printing (2/1),
  - (b1) the first and second blanket cylinders (1, 2) are in engagement, with the substrate (5) therebetween, to print first and second prime and verso images;
  - (b2) the third blanket cylinder (3) is in engagement with the second blanket cylinder (2) with the substrate therebetween, to print a second prime image; and
  - (b3) the third and fourth blanket cylinders are out of engagement with each other.

5. Multi-cylinder printing machine comprising eight printing couples,
- wherein four printing couples, each,
- as claimed in claim 4,
- are located vertically above each other;
- and wherein said substrate (5) comprises a substrate web, guided essentially vertically between the respectively engaged blanket cylinders of said printing couples.

6. The printing machine of claim 4, wherein, for printing in a third mode,
- (c) of double-prime, double-verso printing (2/2),
  - (c1) the first and second blanket cylinders (1, 2) are in engagement, with the substrate (5) therebetween, to print first and second prime and verso images, and (c2) the third blanket cylinder (3) is in engagement with the second blanket cylinder, with the substrate (5) therebetween to apply a second prime image, and (c3) the fourth blanket cylinder (4) is in engagement with the third printing cylinder, with the substrate therebetween, to supply a second verso printing image on the substrate.

* * * * *